United States Patent [19]

McNeill et al.

[11] 4,002,944

[45] Jan. 11, 1977

[54] INTERNAL MATCH STARTER FOR TERMINATION FIXTURE LAMPS

[75] Inventors: William H. McNeill, Carlisle; Paul O. Haugsjaa, Acton; Joseph M. Lech, Westford; Robert J. Regan, Newton, all of Mass.

[73] Assignee: GTE Laboratories Incorporated, Waltham, Mass.

[22] Filed: Nov. 17, 1975

[21] Appl. No.: 632,439

Related U.S. Application Data

[63] Continuation-in-part of Ser. No. 570,109, April 21, 1975, Pat. No. 3,943,403.

[52] U.S. Cl. ..... 315/39; 315/248

[51] Int. Cl.[2] ..... H01J 61/56

[58] Field of Search ..... 315/39, 248, 267, 344; 313/182

[56] References Cited

UNITED STATES PATENTS 3,943,403 3/1976 Haugsjaa et al. ..... 315/39

*Primary Examiner*—Robert Segal
*Assistant Examiner*—Darwin R. Hostetter
*Attorney, Agent, or Firm*—Irving M. Kriegsman; Leslie J. Hart

[57] ABSTRACT

In a light source excited with power at a high frequency, an electrodeless lamp is located in a termination fixture comprising an inner and outer conductor, the lamp being located at the end of the inner conductor. An internal tuning element is located within the fixture for creating a resonant condition when the lamp is to be started to create a maximum electric field for initiating breakdown and excitation of the fill material within the lamp. The tuner may comprise a variable capacitance coupled in parallel across the conductors at the power input end of the fixture or a variable inductance connected across the conductors at the lamp end of the fixture.

3 Claims, 4 Drawing Figures

INTERNAL MATCH STARTER FOR TERMINATION FIXTURE LAMPS

CROSS-REFERENCE TO RELATED PATENT APPLICATION

This patent application is a continuation in part of application Ser. No. 570,109, in the names of Haugsjaa, Regan, McNeill and Lech for IMPROVED ELECTRODELESS LIGHT SOURCE UTILIZING A LAMP TERMINATION FIXTURE HAVING A PARALLEL CAPACITIVE IMPEDANCE MATCHING CAPABILITY, filed Apr. 21, 1975, now U.S. Pat. No. 3,943,403, issued Mar. 9, 1976, and assigned to the same assignee as in the present patent application.

BACKGROUND OF THE INVENTION

The present invention relates to electrodeless light sources excited by high frequency power and, more specifically, to techniques and apparatus for optimizing the transfer of power from a source to the lamp at the time that the lamp is started.

Historically, there have been three methods of exciting discharges with electrodes. The first uses the discharge as a lossy part of either the capacitance or inductance of a tank circuit. A second method is to place the lamp in the path of radiation from a directional antenna. A third method uses a resonant cavity which contains the lamp and a device for matching the cavity input impedance to the source and transmission line. Examples of a device according to this third method may be found in "Microwave Discharge Cavities Operating at 2450 MHz" by F. C. Fehsenfeld et al., Review of Scientific Instruments, Volume 36, Number 3, (March, 1965). Another example of a resonant device is described in the U.S. Pat. No. 3,787,705 to Bolin.

All of these electrodeless light sources have disadvantages which prohibit their being seriously considered as a replacement for the conventional, electrode-containing incandescent light bulb. For example, one of the problems in the development of an electrodeless light source having potential commercial use resides in devising an effective method of starting the lamp. Electrodeless lamps prior to excitation and breakdown of the fill material have an extremely large impedance, whereas once the lamp is operating, the impedance is some lower value ranging up to a few hundred ohms. Thus, the light source should have a convenient, economical and practical way of compensating for the drastic change in load impedance.

SUMMARY OF THE INVENTION

It is an object of the present invention to provide a starting assist device which is internally located with respect to a fixture for the lamp and which is uncomplicated in its structure, rugged, economical, and nearly passive in its nature.

It is an another object of the present invention to provide a starting assist device for an electrodeless light source for starting microwave discharges without the use of applied ultraviolet light, spark discharges or other external devices.

According to the present invention, a light source comprises a source of power at a high frequency, an electrodeless lamp having an envelope made of a light transmitting substance and a volatile fill material which emits light upon excitation and breakdown and a termination fixture for the lamp having an inner conductor and an outer conductor disposed around the inner conductor, the conductors having a first end coupled to the source, and the inner conductor having a second end coupled to the lamp. Accordingly, the termination fixture further has an adjustable tuning device capable of making the fixture a resonant cavity for creating an intense electric field in the fixture for starting the lamp, thereby coupling all the incident power to the fixture.

In one embodiment of the invention, the tuning device comprises an adjustable capacitance coupled in parallel across the conductors at the first or source-coupled end. The value of the capacitance is adjustable externally so that the fixture may be tuned to the resonant condition for starting and readjusted for an optimum value after excitation and breakdown of the fill material. Alternatively, the tuning device may comprise an inductive device at the second or lamp end of the conductors adapted to be momentarily connected across the conductors to create a resonant condition at starting. Preferably, the inductive device is an externally operable conductive post which is located through an aperture in the outer conductor and is moved into the region between the conductors.

DESCRIPTION OF PREFERRED EMBODIMENTS

In typical electrodeless lamps, starting takes place via Penning ionization with argon, the major constituent, and mercury, the minor one. In order to ensure a sufficient number of excited argon atoms to promote enough mercury ionization for reliable starting, it is necessary that the microwave electric field be greater than approximately 150 V/cm. This high level cannot be obtained in a termination fixture of the type herein described unless a tuning element is used, making the fixture a resonant structure prior to the lamp starting. In general, this tuning element can be either external or internal to the fixture. A pending patent application Ser. No. 570,113 filed Apr. 21, 1975 describes a stub type tuner to assist in starting lamps. This external tuner is adjusted to minimize power reflected from the tuner-fixture system, so that essentially all of the power being generated by the microwave source was coupled into this system. At this point, under most conditions, the lamp would start; i.e., the strong electric field was sufficient to break down the gas inside the lamp envelope. However, this system for starting does not have the advantage of compactness which is desirable in an electrodeless light source having commercial uses.

An estimate of the field strengths that can be attained by a resonant device can be obtained by noting that, for a tuned cavity, the incident power is all coupled into the cavity, and is dissipated there:

$$P_i = P_C = P_L$$

where $P_C$ is the power coupled into the cavity, and $P_L$ is the power dissipated in the cavity. The more power dissipated, the higher the field strength within the cavity, and vice versa, and also the field strength is higher for high Q cavities. In fact, at resonance $$E = C\sqrt{P_C Q}$$

where Q is the cavity quality factor, and E is the field strength, C is a constant that depends on the cavity geometry, the lamp geometry, and the frequency. In order for the field strength to be high, it is essential that $P_C$ be equal to $P_i$, the incident power. This will only be achieved if a tuning element is used. Thus, the device disclosed here has the following advantages. An internal tuning element allows all the incident power to be coupled into the cavity. Also, an internal tuner will tend to make the system Q much higher than an external tuner, leading to higher starting fields.

Figure 1:
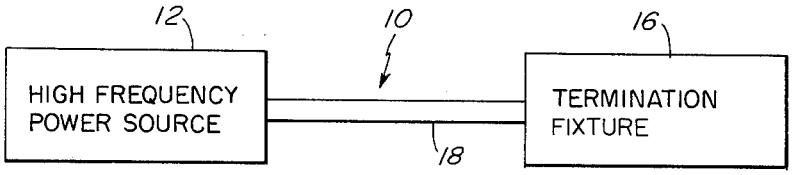
FIG. 1 is a block diagram of an electrodeless light source according to the invention.
Figure 2:
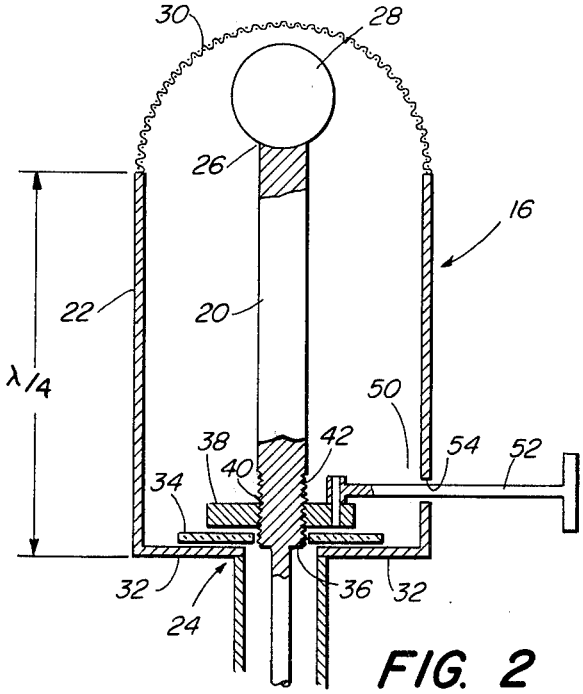
FIG. 2 is a sectional view with portions removed of a termination fixture having a variable parallel capacitance at the source-coupled end of the fixture for creating a resonant condition in the fixture during the lamp starting mode.

In an exemplary embodiment of the present invention, as shown in FIG. 1, a light source, indicated by the reference numeral 10, includes a source 12 of power at a high frequency, an electrodeless lamp 28 and a termination fixture 16 coupled to the source, such as by a transmission cable 18. As used herein, the phrase "high frequency" is intended to include frequencies in the range generally from 10 MHz to 300 GHz. Preferably, the frequency is in an ISM band (i.e., industrial, scientific and medical band) one of which ranges from 902 MHz to 928 MHz. In the embodiment of FIG. 2, the frequency used was 915 MHZ. One of many commercially available power sources which may be used is an Airborne Instruments Laboratory Power Signal Source, type 125. The lamp 28 has an envelope made of a light transmitting substance, such as quartz. The envelope encloses a volatile fill material which emits light upon excitation and breakdown. The following are specific examples of lamps and fill materials which may be used.

EXAMPLES I

Fill Material 9.1 mg. mercury
10 torr of argon

Envelope

Quartz sphere having a 15 mm. ID

EXAMPLE II

Fill Material 8.9 mg. of mercury
1.5 mg. of $ScI_3$
1.7 mg. NaI
20 torr of argon

Envelope

Quartz sphere having a 15 mm. ID

EXAMPLE III

Another fill material is 2 or 3 atoms of sodium for each mercury atom to yield under operating conditions 200 torr sodium partial pressure and about 1,000 torr mercury partial pressure. The envelope is a material which is resistant to sodium such as translucent $Al_2O_3$.

Referring now to FIG. 2, the termination fixture 16 has an inner conductor 20 and an outer conductor 22 which is disposed around the inner conductor 20. The conductors have a first end, represented generally by the reference numeral 24 which is coupled to the source 12. The inner conductor 20 has a second end 26 which is coupled to the lamp 28. The fixture may be provided with a shield 30 disposed over the top of the opening of the outer conductor 22. According to the invention, a fixture 16 has an adjustable tuning device capable of making the fixture a resonant cavity for creating an intense electric field in the fixture for starting the lamp. In operation, the lamp impedance at starting is complex and has a capacitive reactance component. The tuning device includes the capability of introducing a component of impedance effective to compensate for the capacitive reactance part of the lamp impedance. As shown in FIG. 2, this capability is provided by the use of a capacitance in parallel across the inner and outer conductors at the first end 24 of the conductors. The outer conductor 22 is formed with an end plate 32 extending generally perpendicularly to both the outer conductor 22 and the inner conductor 20. A dielectric material, such as Mylar, 34 is formed with an aperture 36 through which the inner conductor is located. The dielectric material 34 is thus adjacent to the plate 32. A conductive plate 38 is formed with an aperture 40 such as to receive the inner conductor 20, the plate being on the opposite side of the dielectric material 34.

The capacitive device preferably includes a means for varying the spacing between the plate 38 in electrical contact with the inner conductor 20 and the plate 32 which is in contact with the outer conductor 22. Preferably, this is accomplished by forming the first end 24 of the inner conductor with external threads 42 which engage threads on the walls of the aperture 40 in the conductive plate 38. In operation, the spacing between the plates 38 and 32 may be controlled by rotating the plate 38 with respect to the inner conductor 20. Preferably, a device represented generally by the reference numeral 50 is provided for externally controlling the rotation of the plate 38. The device 50 includes a non-conducting arm 52 extending through an aperture 54 in the outer conductor 22, and connected by means of a pivot to the plate 38. In operation, by adjusting the capacitor to a high value of capacitance, most of the incidence power is coupled into the fixture. Under these conditions, lamps of various chemical fills can be started at power levels as low as 20 watts. This same capacitor may be adjusted to another lower value for the running condition, such as is described in the parent patent application Ser. No. 570,109, filed Apr. 21, 1975.

Figure 3:
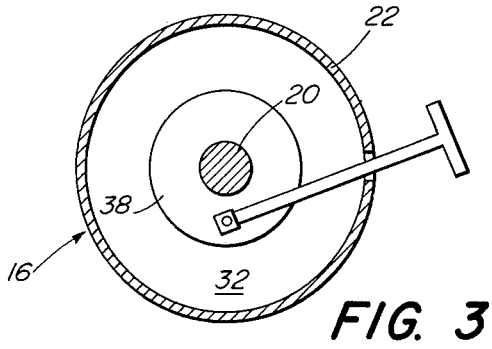
FIG. 3 is a plan view of the fixture shown in FIG. 2.
Figure 4:
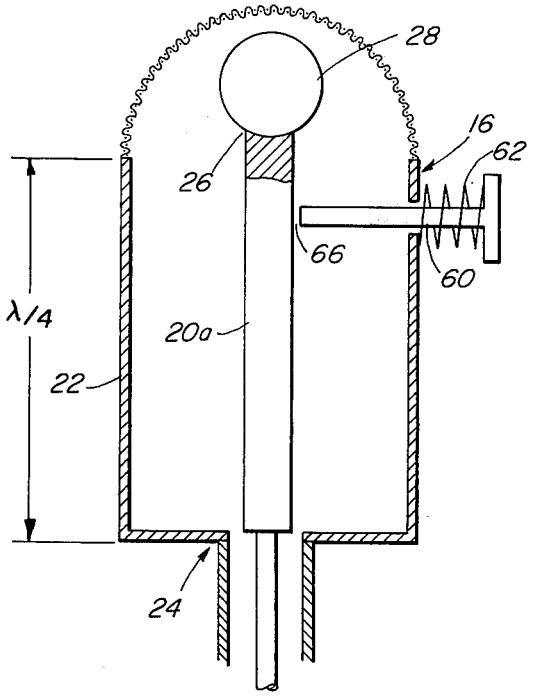
FIG. 4 is a sectional view of an alternative embodiment of a termination fixture in which an adjustable parallel inductance is provided at the lamp-coupled end of the fixture for creating a resonant condition during the lamp starting mode.

Referring now to FIG. 4, there is illustrated a tuning device for introducing an inductive reactive impedance component in parallel across the inner and outer conductor 20*a* and 22, respectively, substantially at the second end 26, of the conductors. As shown in FIG. 4, in the preferred form of this device there is provided a post 60 made of a conductive material. In a coaxial line, such as illustrated by the inner and outer conductors themselves, a parallel inductance can be introduced by simply placing a conductive post between the inner and outer conductors. Preferably, the post 60 is spring loaded such as by the use of a spring 62, and is adapted to be pressed against the inner conductor 20*a* at 66 thereby introducing a parallel inductance which tunes the fixture 16 when the lamp is in the OFF condition. In operation, after starting of the lamp, the post 60 is released and the spring 62 removes the post 60 to a position where its effect on lamp operation promotes optimum lamp performance in the ON condition. In the embodiments of FIG. 3 and FIG. 4, the termination fixture 16 is a quarter-wave device.

The embodiments of the present invention are intended to be merely exemplary and those skilled in the art shall be able to make numerous variations and modifications of them without departing from the spirit and scope of the present invention. All such variations and modifications are intended to be within the scope of the present invention as defined by the appended claims.

We claim:

1. A light source comprising:

a. a source of power at a high frequency, b. an electrodeless lamp having an envelope made of a light transmitting substance and a volatile fill material which emits light upon excitation and breakdown, c. a termination fixture for the lamp having an inner conductor and an outer conductor disposed around the inner conductor, the conductors having a first end coupled to the source and the inner conductor having a second end coupled to the lamp, and d. the termination fixture further having an adjustable tuning device capable of making the fixture resonant at the operating frequency so as to create an intense electric field in the fixture for starting the lamp thereby to couple more incident power into the lamp, the lamp impedance at starting being complex having a capacitive reactance component, the tuning device having tuning means for introducing a component of impedance effective to compensate for the capacitive reactance component of the lamp impedance, the tuning means further having means for introducing an inductive reactance impedance component in parallel across the inner and outer conductors substantially at the second end of the conductors.

2. The light source according to claim 1, wherein the inductive means includes a conductive post located in an aperture in the outer conductor and adapted to be inserted toward the inner conductor.

3. The light source according to claim 2 further including a post being spring loaded such that in the static condition, the post is not disposed in the effective starting region between the conductors.

* * * * *